US007647002B2

(12) United States Patent
Ohanyan

(10) Patent No.: US 7,647,002 B2
(45) Date of Patent: Jan. 12, 2010

(54) DRUM REMOVAL APPARATUS AND METHODS

(75) Inventor: Tigran Ohanyan, Burbank, CA (US)

(73) Assignee: Future Graphics Imaging Corporation, San Fernando, CA (US)

( * ) Notice: Subject to any disclaimer, the term of this patent is extended or adjusted under 35 U.S.C. 154(b) by 25 days.

(21) Appl. No.: 12/229,608

(22) Filed: Aug. 26, 2008

(65) Prior Publication Data

US 2009/0060566 A1 Mar. 5, 2009

Related U.S. Application Data

(63) Continuation-in-part of application No. 11/598,964, filed on Nov. 14, 2006, now Pat. No. 7,546,062.

(60) Provisional application No. 61/125,512, filed on Apr. 25, 2008.

(51) Int. Cl.
*G03G 15/00* (2006.01)

(52) U.S. Cl. ..... 399/109

(58) Field of Classification Search ..... 399/107, 399/109, 110, 111, 116, 117; 156/73.1, 73.5, 156/94

See application file for complete search history.

(56) References Cited

U.S. PATENT DOCUMENTS 6,788,909 B2 * 9/2004 Prichett ..... 399/117
7,321,742 B2 * 1/2008 Fujishiro et al. ..... 399/159
7,590,369 B2 * 9/2009 Wazana et al. ..... 399/109

* cited by examiner

*Primary Examiner*—Hoan H Tran

(57) ABSTRACT

A device for detaching a drum from a printer cartridge, the drum including a drum flange that attaches the drum to the printer cartridge, the device including a pressure transmitting device; and a rod operatively connected to the pressure transmitting device, wherein the pressure transmitting device and the rod are configured to apply pressure to the drum flange and cause the drum to be detached from the printer cartridge.

20 Claims, 10 Drawing Sheets

DRUM REMOVAL APPARATUS AND METHODS

CROSS REFERENCES TO RELATED APPLICATIONS

This application claims the benefit of U.S. provisional patent application Ser. No. 61/125,512 filed Apr. 25, 2008. This application is also a continuation in part application of U.S. patent application Ser. No. 11/598,964 filed Nov. 14, 2006 now U.S. Pat. No. 7,546,062.

FIELD OF INVENTION

The present invention relates to electrophotography, particularly methods and apparatus for remanufacturing toner cartridges.

BACKGROUND

Generally, printers embed toner on paper by relying on electrical charges occurring within the printer cartridges. Printer cartridges typically include a toner hopper, a primary charge roller, and a drum. The toner is typically stored in the toner hopper and carries a negative charge. The drum is typically given a charge by a primary charge roller or PCR. The charge of the drum is typically more positive than the charge of the toner, and thus the drum is able to attract the toner. Once the drum is given a charge by the PCR and a print pattern is set, the drum gets coated with toner. The drum that is coated with toner then rolls over a sheet of paper, which is usually given a negative charge by the PCR. The charge of the paper is less negative than the charge of the toner, and thus the paper attracts the toner. The toner is embedded on the paper according to the print pattern.

Used printer cartridges of fax machines, copiers, inkjet printers, and laser printers are often remanufactured. The drum is usually one of the components that wears out from usage and gets replaced during remanufacturing. In some printer cartridges, such as those manufactured by Hewlett Packard company having model numbers HP 1600, HP 2600, and HP 2605, the drum 2 may be attached to one end of the printer cartridge 4 by a drum flange 6 (FIG. 1). The drum flange 6 may be positioned in between the drum 2 and the cartridge end cap 8. Referring to FIG. 2, a drum portion 10 of the drum flange 6 may be inserted through the drum 2 and an end cap portion 12 of the drum flange 6 may be inserted through the cartridge end cap 8. The drum flange 6 attaches the drum 2 to the printer cartridge 4 by being connected to both the drum 2 and the cartridge end cap 8. It can be realized that the drums are attached to the cartridges in a manner that may require breaking the cartridges.

It is desirable to be able to detach the drums from printer cartridges without having to break parts of the cartridges. This helps preserve the appearance of the cartridges and minimizes remanufacturing steps. Methods and apparatus for efficiently and quickly detaching the drums from the cartridges are desired and are addressed by the present invention.

BRIEF DESCRIPTION OF THE PREFERRED EMBODIMENTS OF THE PRESENT INVENTION

The present invention includes a device for detaching a drum from a cartridge, the device comprising a drive means for driving a drive shaft and a drive shaft attached to the driving means, the drive shaft being configured to drive a drum flange into the drum.

The present invention also includes a method of removing a drum from a printer cartridge, the drum being attached to the printer cartridge by at least one drum flange, the drum having a hollow interior, the method comprising driving the drum flange towards the interior of the drum.

The present invention also includes a device for detaching a drum from a printer cartridge, the drum comprising a drum flange that attaches the drum to the printer cartridge, the device comprising: a pressure transmitting device; and a rod operatively connected to the pressure transmitting device, wherein the pressure transmitting device and the rod are configured to apply pressure to the drum flange and cause the drum to be detached from one end of the printer cartridge.

The above description sets forth, rather broadly, a summary of embodiments of the present invention so that the detailed description that follows may be better understood and contributions of the present invention to the art may be better appreciated. Some of the embodiments of the present invention may not include all of the features or characteristics listed in the above summary. There may be, of course, other features of the invention that will be described below and may form the subject matter of claims. In this respect, before explaining at least one embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways.

DESCRIPTION OF THE PREFERRED EMBODIMENTS

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention. Also, it is to be understood that the phraseology and terminology employed herein are for the purpose of description and should not be regarded as limiting.

The order in which the steps are presented below is not limited to any particular order and does not necessarily imply that they have to be performed in the order presented. It will be understood by those of ordinary skill in the art that the order of these steps can be rearranged and performed in any suitable manner. It will further be understood by those of ordinary skill in the art that some steps may be omitted or added and still fall within the spirit of the invention.

Figure 3:
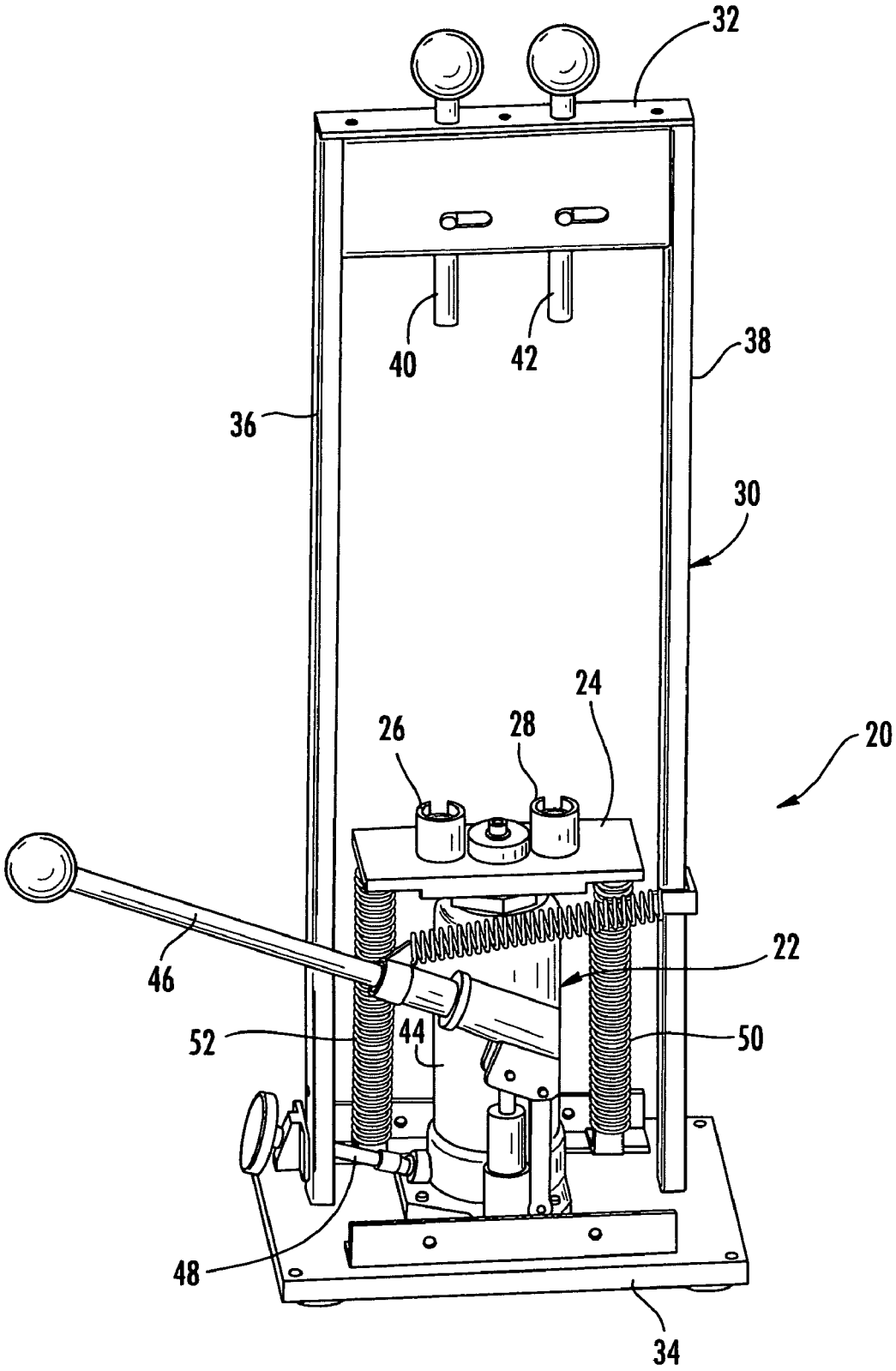
FIG. 3 is substantially a front view of an embodiment of the drum removal device of the present invention.

The present invention provides various devices and techniques for removing an organic photoconductor ("OPC") or drum from a printer cartridge. Referring now to FIG. 3, an embodiment of the drum removal device 20 preferably includes a pressure transmitting device 22 attached to a printer cartridge stage 24. The printer cartridge stage 24 is preferably configured to hold one or multiple printer cartridges that have OPCs that need to be detached from the printer cartridges. The printer cartridge stage 24 preferably includes a plurality of rings 26 and 28 to controllably hold ends of printer cartridges. The number of rings 26 and 28 and the size of the stage 24 may vary depending on the number of printer cartridges that are desired to be serviced.

The drum removal device embodiment preferably also includes a frame 30 that has four interconnected sides a top side 32, a bottom side 34, and a pair of parallel vertical sides 36 and 38. The pressure transmitting device 22 is preferably attached to the bottom side 34 of the frame 30. The top side 32 of the frame 30 preferably includes a plurality of push rods 40 and 42. In the preferred embodiment, the pressure transmitting device 22 is preferably a bottle jack, which is known in the art. The bottle jack may include a cylinder 44 that houses a main lift (not shown). The main lift is preferably connected to the stage 24. The main lift may be connected to a lever 46. The bottle jack may also include a release stem 48 to release the pressure to the main lift thereby lowering the main lift and consequently the stage 24. A plurality of biasing devices 50 and 52, such as springs, may be attached to the stage 24 to assist the main lift in lowering the stage 24.

Figure 1:
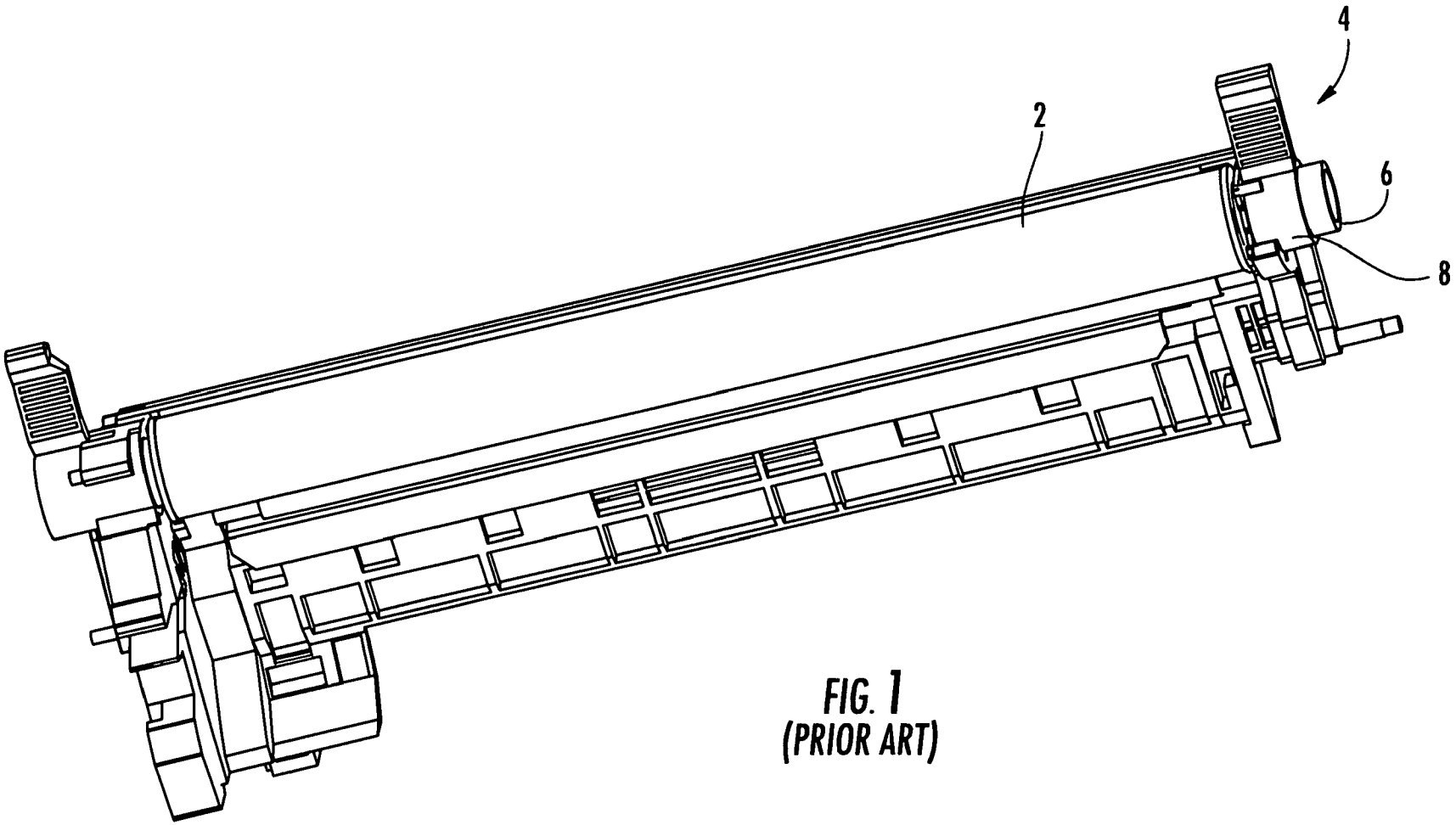
FIG. 1 (PRIOR ART)
FIG. 1 is substantially a perspective view of a waste hopper and drum section of an existing printer cartridge for which the devices and printer remanufacturing methods of the present invention may be applied.
Figure 2:
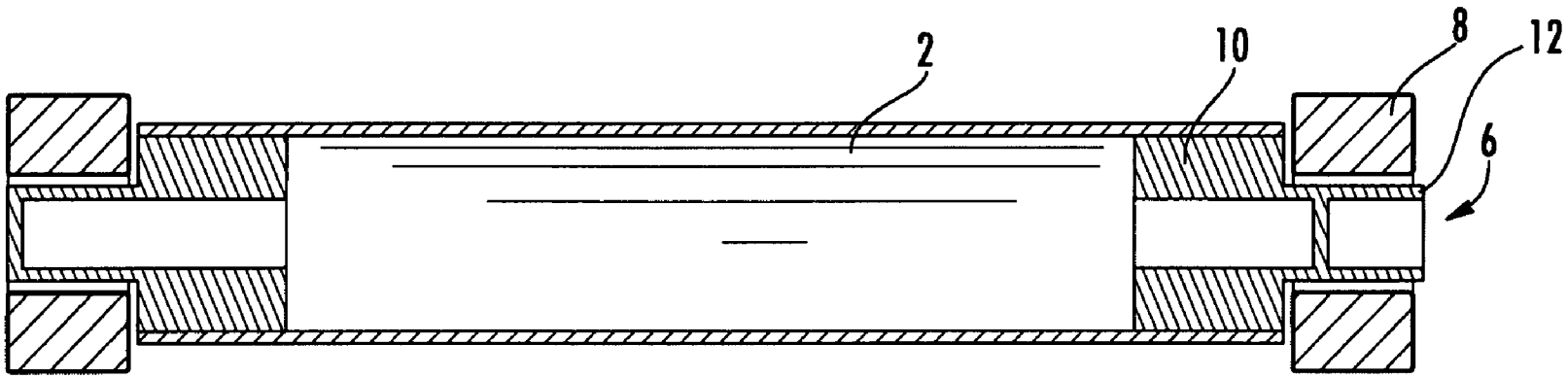
FIG. 2 (PRIOR ART)
FIG. 2 is substantially a cross-section view of the drum of the printer cartridge in FIG. 1 attached to the end cap of the printer cartridge.
Figure 5:
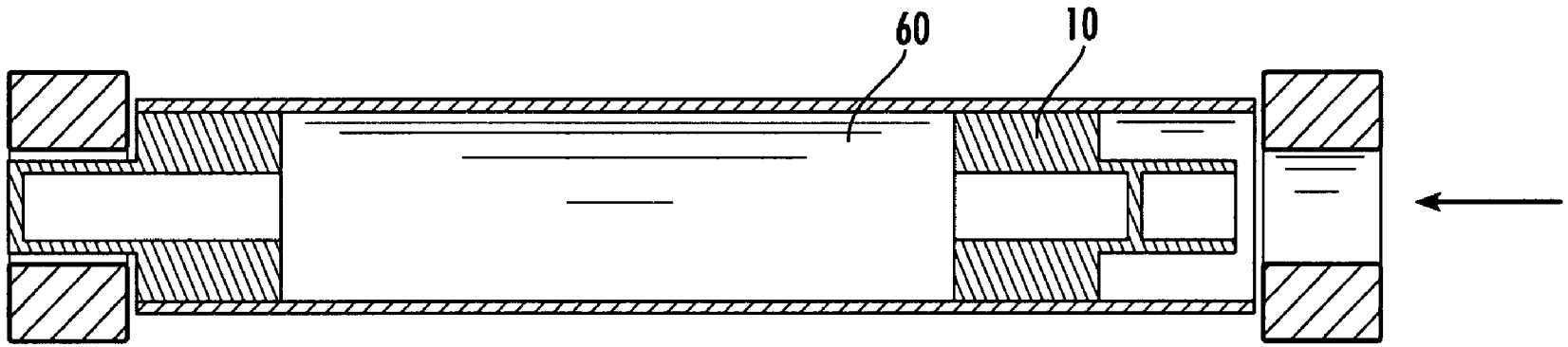
FIG. 5 is substantially a cross-section view of the drum of the printer cartridge in FIG. 1 with one end being detached from the end cap of the printer cartridge.
Figure 4:
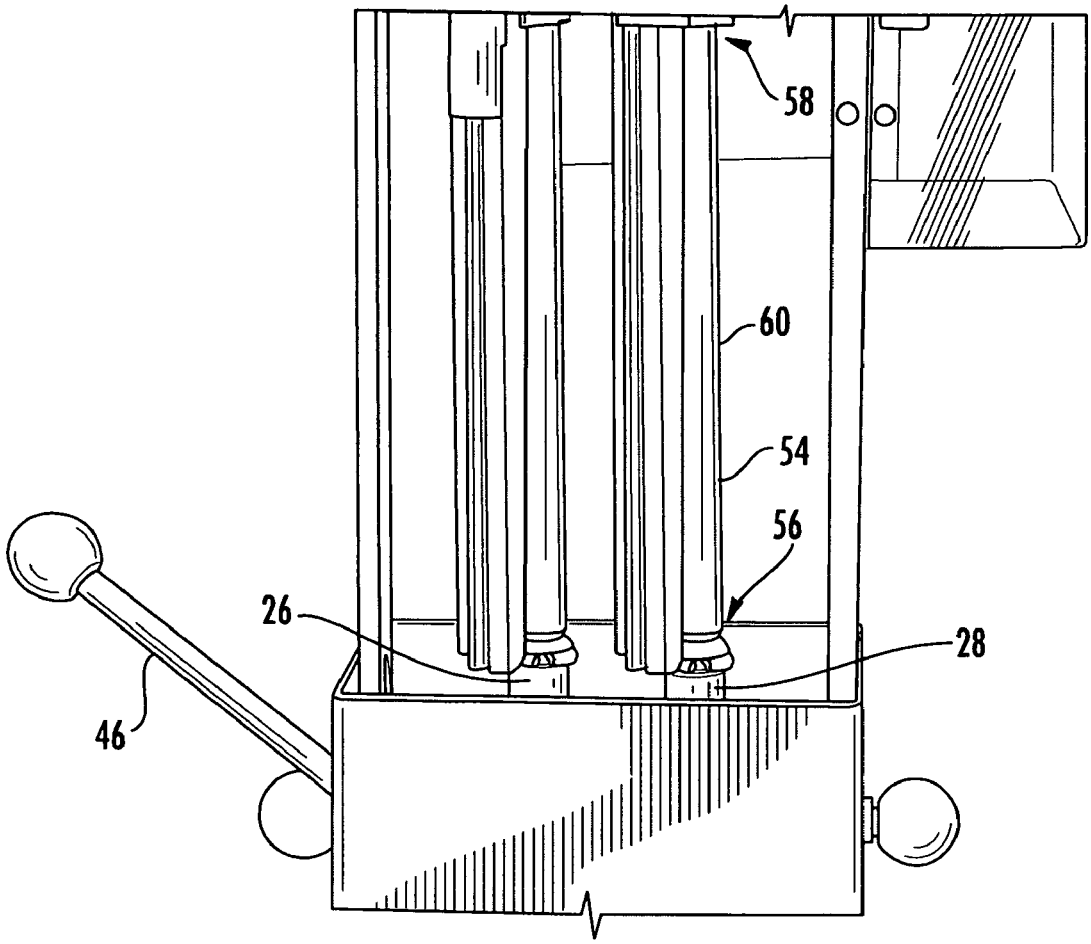
FIG. 4 is substantially a front view of another drum removal device embodiment showing cartridges being positioned thereon for drum removal.

Referring now to FIG. 4, in use, one or plurality of printer cartridges 54 may be positioned vertically on the stage 24. Each end 56 of the printer cartridge is preferably positioned within the ring 26 or 28. The push rod 40 or 42 is preferably inserted through the opposite end of the printer cartridge. The bottle jack lever 46 may then be pumped to lift the main lift and the stage 24. As the stage 24 elevates, the cartridge end 58 that is in contact with the push rod 40 or 42 is subjected to pressure from the push rod 40 or 42 and the pressure transmitting device 22. The push rod 40 or 42 eventually pushes a drum flange 6 of the OPC 2 (FIG. 5) through the cylindrical interior of the OPC 2 causing the OPC 2 to be detached from the cartridge end cap 8.

Figure 6:
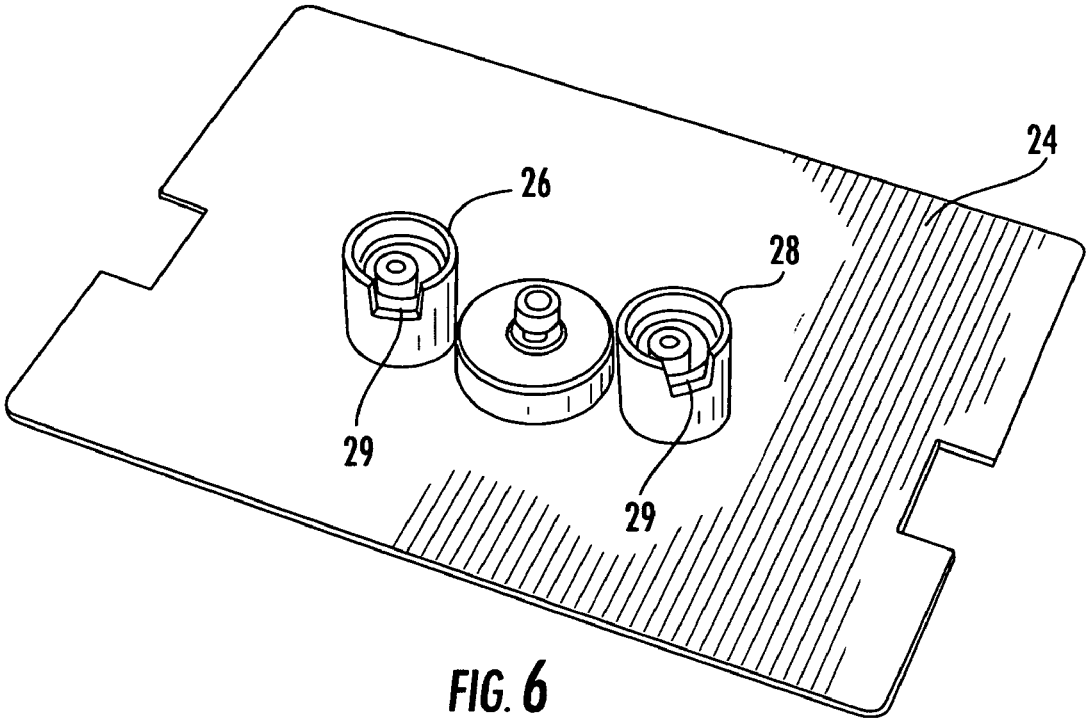
FIG. 6 is substantially a perspective view of an embodiment of the printer cartridge receptacle of the present invention.

Referring now to FIG. 6, the structures of the stage 24 and the rings 26 and 28 will now be explained in detail. Stage 24 is preferably a substantially flat piece of material, such as stainless steel. The rings 26 and 28 are preferably removably attached to the stage 24. Each ring 26 or 28 is preferably cylindrical and has open ends. One end of each ring is preferably attached to the stage 24, and the opposite end preferably includes a notch 29 to accommodate a piece of the printer cartridge, such as its handle, to further secure the printer cartridge to the ring.

Figure 7:
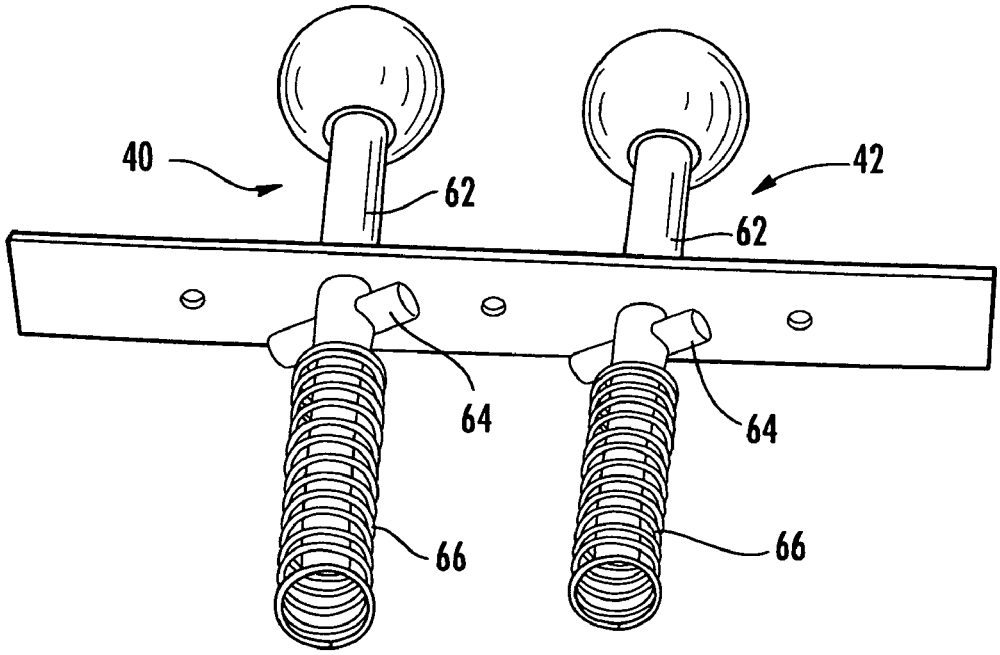
FIG. 7 is substantially a top plan view of the push rods of the drum removal device embodiment of FIG. 3.
Figure 8:
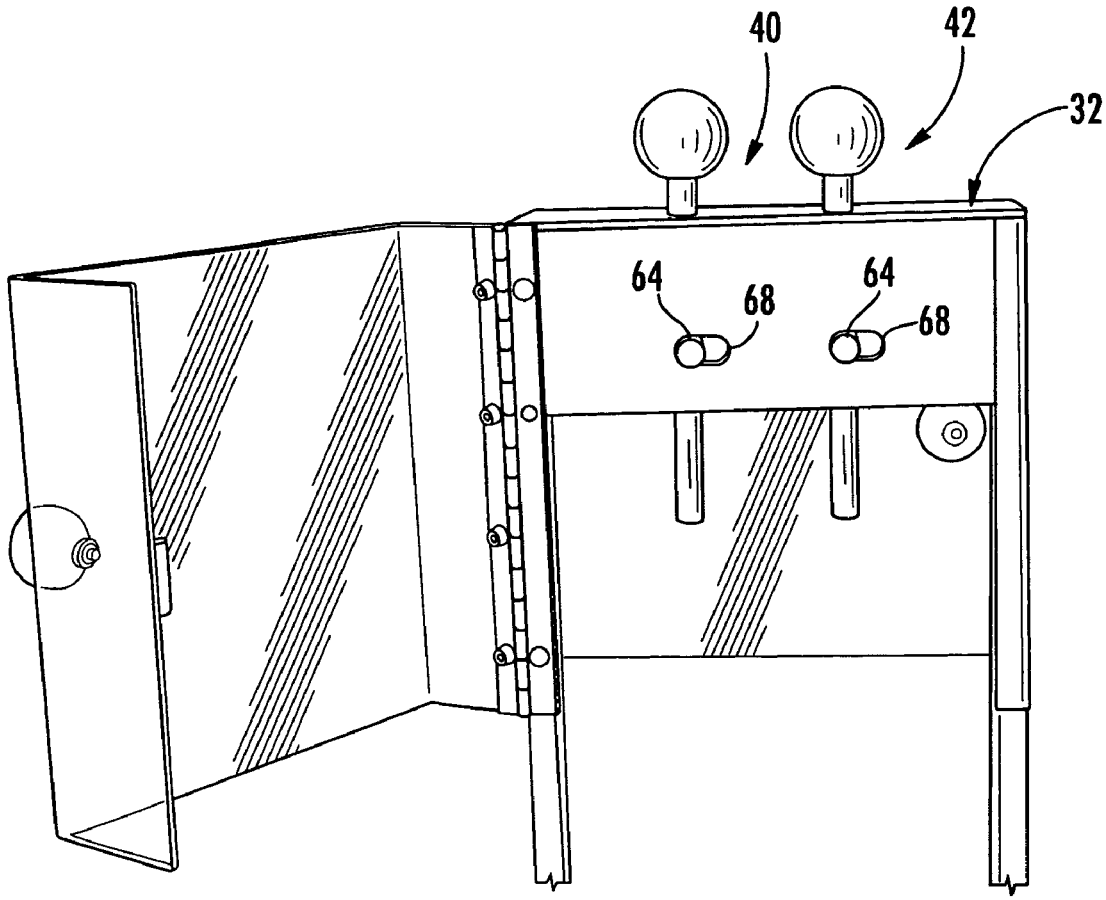
FIG. 8 is substantially a front view of the top side of the frame of another drum removal device embodiment.

With reference now to FIG. 7, the structure and components of the push rods 40 and 42 will now be explained in detail. Each push rod 40 or 42 preferably includes an elongate body 62. Adjacent and perpendicularly attached to the middle of each elongate body 62 is a rod stop 64. Each push rod 40 or 42 preferably includes a biasing device 66 positioned around the lower half of each push rod and past each of the rod stop 64. Referring now to FIG. 8, each push rod 40 or 42 may either be in a locked or unlocked position relative to the top side 32 of the frame 30. When the printer cartridge is being positioned within the frame 30, the push rod is preferably unlocked. When one end of the printer cartridge is positioned within the ring 26 or 28 and the push rod 40 or 42 is inserted within the other end of the printer cartridge, the push rod 40 or 42 may be pushed down towards the ground until the rod stop 64 reaches the slot 68 of the top side 32 of the frame. The push rod 40 or 42 may be turned to engage the rod stop 64 with the slot 68 thereby locking the push rod 40 or 42. It can be appreciated that the locking of the push rod 40 or 42 allows the pressure transmitting device 22 to apply pressure to the printer cartridge that is adequate to push the drum flange into the interior of the OPC.

Figure 9:
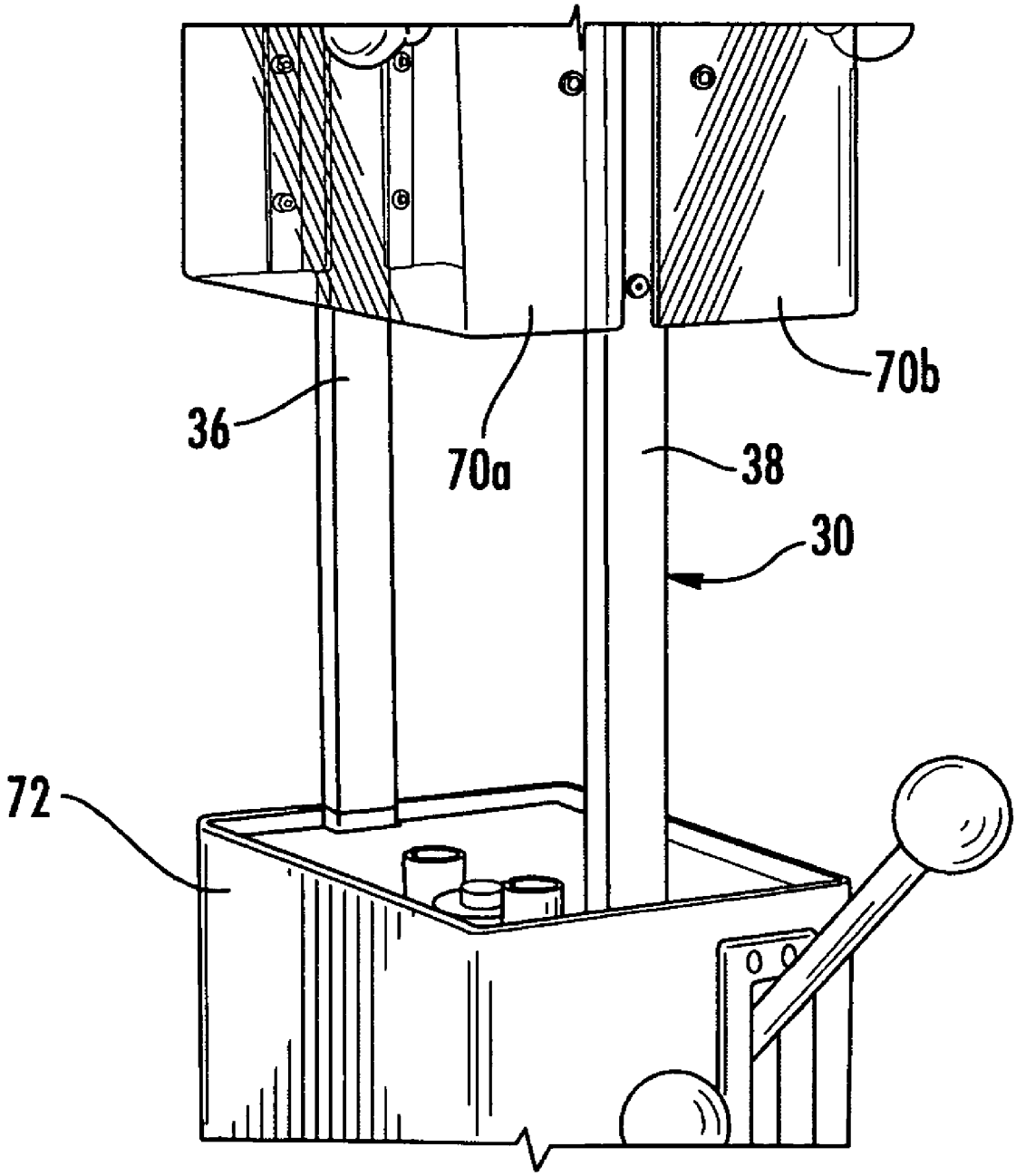
FIG. 9 is substantially a perspective view of the drum removal device embodiment of FIG. 8 with frame doors and bottle jack covers.

It is noted that in other embodiments, the pressure transmitting device 22 may be in a form of a mechanical jack, a pneumatic device, a hydraulic device, or a combination of a pneumatic and hydraulic device, all of which are known in the art. Other embodiments, such as shown in FIG. 9, may include doors 70*a* and 70*b* that may be positioned around the top portion of the frame and may pivot on one of the vertical sides 36 or 38 of the frame 30. The doors 70*a* and 70*b* may provide a user some protection against objects that may fly out of the printer cartridge during the OPC removal. The drum removal device may also include a cover 72 surrounding the pressure transmitting device 22. The cover 22 may define slots that would accommodate the lever 46 and the release stem 48.

Figure 10:
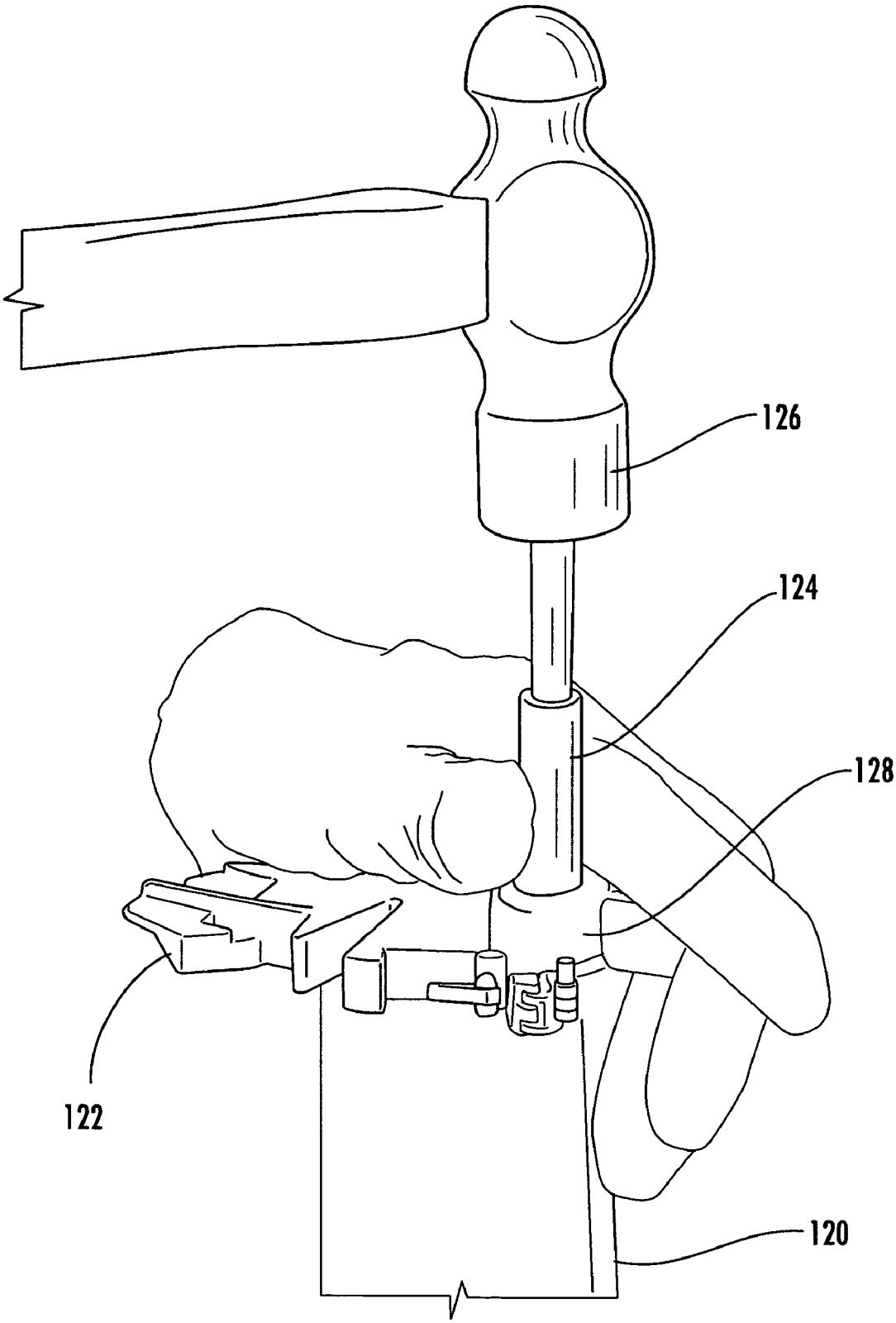
FIG. 10 is substantially a view of another method of printer cartridge drum removal of the present invention.

Referring now to FIG. 10, the present invention provides additional methods of detaching a drum 120 from a printer cartridge 122. The drum may be detached from the printer cartridge by providing pressure that can move or drive a drum flange, which attaches the drum 120 to the printer cartridge 122, towards the interior of the drum. In one embodiment, the drum flange 6 may be tapped using an appropriately sized center punch 124 and a hammer 126 (FIG. 10). The center punch 124 is preferably appropriately sized to preferably penetrate through the end cap 128 of the printer cartridge. For instance, in HP2600 printers, a center punch with ⅜ inch of diameter can penetrate through the end cap.

Figure 11:
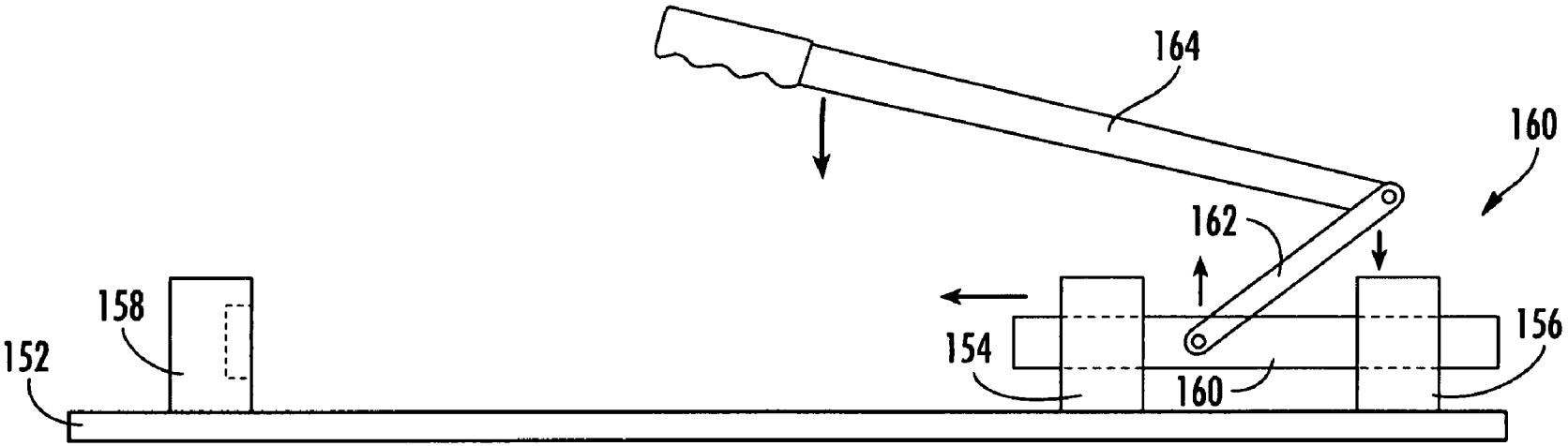
FIG. 11 is substantially a front view of another embodiment of the drum removal device of the present invention.

Referring now to FIG. 11, another embodiment of a drum removal device is shown that includes a fixture 150, a base 152, a pair of driveably shaft mounts 154 and 156 attached to the base 152, and a cartridge mount 158 also attached to the base 152. A driveable shaft 160 may be inserted within the shaft mounts 154 and 156. A connecting rod 164 may be attached to the driveable shaft 160 and the lever 164 so that when the lever 164 is pushed down, the connecting rod 162 causes the driveable shaft 160 to move forward towards the cartridge mount 158 thereby providing a driving action for the driveable shaft 160 to push the drum flange inside the drum. It is noted that the driveable shaft 160 may be driven by other mechanisms. For instance, the driveable shaft 160 may be threaded so that it can be driven using a worm gear or a drill. The driveable shaft 160 may also be provided with an air powered driving mechanism. A cartridge (not shown) may be placed on the fixture 150 by allowing the cartridge mount 158 to receive a portion of one end of the cartridge, such as an end cap, and inserting the driveable shaft 160 to the opposite end of the cartridge where the driveable shaft 160 can contact and push the flange (not shown) towards the inside of the drum (not shown).

Figure 12:
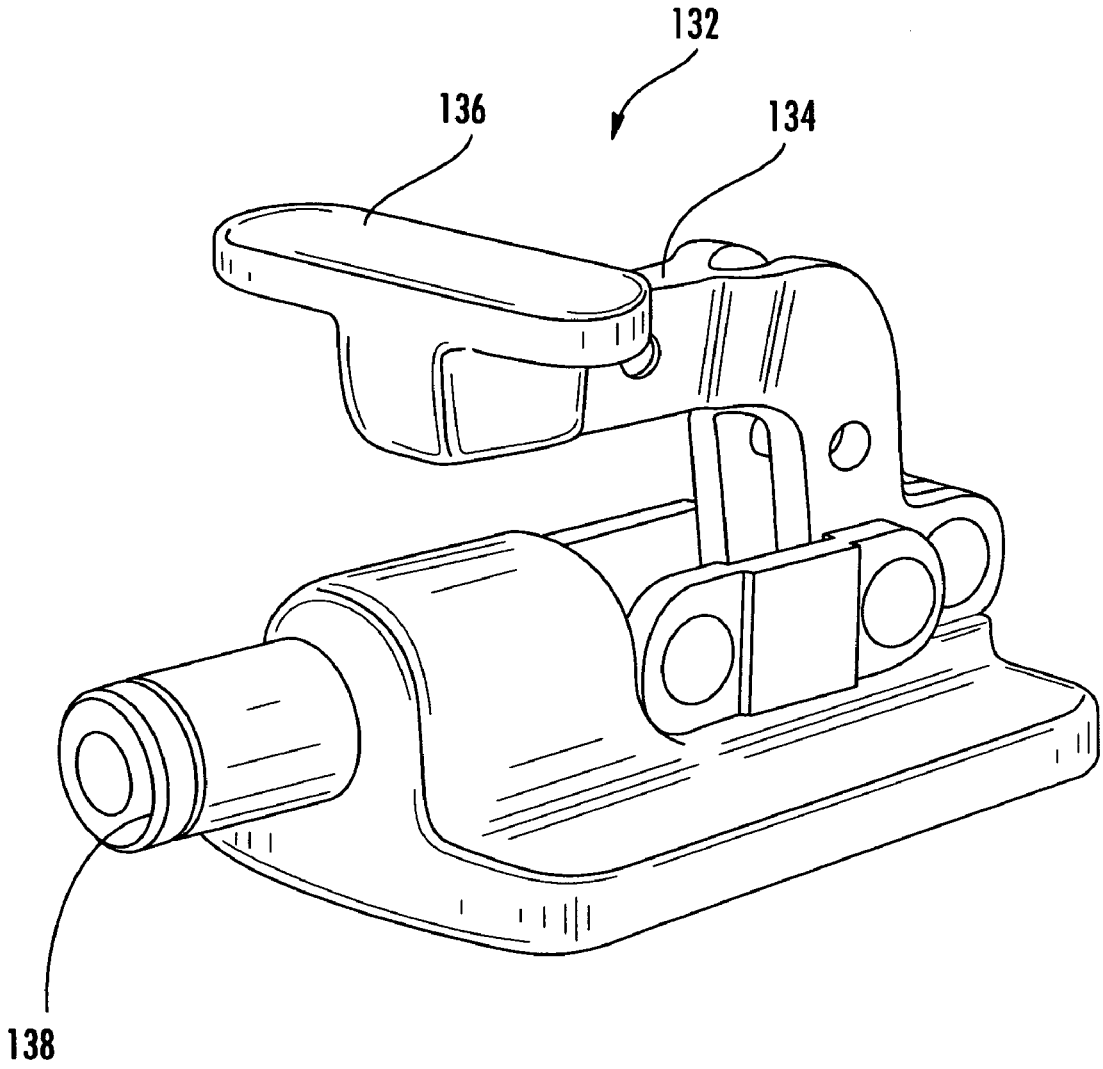
FIG. 12 is substantially a front view of another embodiment of a drum flange driver of the present invention.

In another embodiment shown in FIG. 12, a clamp 132, such as a straight line action clamp from De-Sta-Co Workholding company of Auburn Hills, Mich. may be used in lieu of the driveable shaft 160, connecting rod 162, and lever 164. The clamp preferably 132 includes a lever 134 and a handle 136. The lever 134 is preferably connected to a drive shaft 138. As the lever 314 134 is moved by moving the handle 136, the lever 134 preferably causes a sliding or driving motion to the drive shaft 138, which subsequently drives the drum flange out of one of the printer cartridge end caps and towards the inside of the drum. The drive shaft of the clamp 132 may be positioned so that it is in line with the flange and can drive the drum flange into the drum. An additional hold-down clamp (not shown) may be added to the fixture to further prevent printer cartridge movement during the detachment of the drum.

It can now be realized that the present invention facilitates the removal of the drum with little or no requirement of having to break any portion of the cartridge. This advantage is highly beneficial in the remanufacturing of cartridges, as the appearance of the cartridge is preserved. Additionally, since the removal of the drum by the present invention reduces or avoids having to break any portion of cartridges, the present invention avoids extraneous steps of having to put back broken cartridges. It can also be realized that the present invention provides new techniques for efficiently removing and replacing a toner cartridge drum in a high volume printer cartridge remanufacturing environment.

Although the description above contains many specifications, these should not be construed as limiting the scope of the invention but as merely providing illustrations of some of the presently preferred embodiments of this invention. For example, various mechanisms for driving the drum bearing hub inside the drum may be used. The invention is capable of other embodiments and of being practiced and carried out in various ways. The invention is not limited in its application to the details of the construction and to the arrangement of the components set forth in the above description or as illustrated in the drawings.

The invention claimed is:

1. A device for detaching a drum from a printer cartridge, the device comprising:

a. a receptacle configured to hold the printer cartridge from a first end;

b. a pressure device connected to the receptacle;

c. a first rod positioned on the device at a position opposite to the receptacle, the first rod configured to hold the printer cartridge from a second end, the first rod being configured to drive a drum flange of the printer cartridge through the drum, wherein the driving of the drum flange through the drum allows the drum to be detached from one end of the printer cartridge.

2. The device of claim 1, further comprising a frame, the frame comprising a first end, the first end being connected to the receptacle, the frame further comprising a second end, the second end being connected to the first rod.

3. The device of claim 1, further comprising:

a. a second rod, the second rod being in parallel position to the first rod; and b. a second receptacle, the second receptacle being positioned adjacent to the first receptacle, wherein the first rod and first receptacle are configured to hold a first printer cartridge, and the second rod and the second receptacle are configured to hold a second printer cartridge.

4. A device for detaching a drum from a printer cartridge, the drum comprising a drum flange that attaches the drum to the printer cartridge, the device comprising:

a. a pressure transmitting device; and b. a rod operatively connected to the pressure transmitting device, wherein the pressure transmitting device and the rod are configured to apply pressure to the drum flange and cause the drum to be detached from one end of the printer cartridge.

5. The device of claim 4, further comprising at least one receptacle connected to the pressure transmitting device, the at least one receptacle configured to hold at least one printer cartridge.

6. The device of claim 4, wherein the printer cartridge is configured to be positioned in between the pressure transmitting device and the rod.

7. The device of claim 4, further comprising a frame, the frame comprising a first side and a second side positioned opposite the first side, the pressure transmitting device being attached to the first side and the rod being attached to the second side.

8. A device for detaching a drum from a printer cartridge, the printer cartridge comprising a drum flange that attaches the drum to the printer cartridge, the device comprising:

a. a pressure means for transmitting pressure; and b. a drive means for moving a drum flange of the printer cartridge, the drive means being configured to work with the pressure means to move the drum flange, wherein the movement of the drum flange allows the drum to be detached from one end of the printer cartridge.

9. The device of claim 8, wherein the pressure means comprises a bottle jack.

10. The device of claim 8, wherein the pressure means comprises a mechanical jack.

11. The device of claim 8, wherein the pressure means comprises a hydraulic cylinder.

12. The device of claim 8, wherein the pressure means comprises a pneumatic device.

13. The device of claim 8, wherein the pressure means comprises a hydraulic device and a pneumatic device.

14. A method of detaching a drum from a printer cartridge, the drum comprising a drum flange that connects the drum to an end cap of the printer cartridge, the method comprising the steps of applying pressure to the drum flange until the drum flange is detached from the end cap.

15. The method of claim 14, wherein the pressure is generated by a bottle jack.

16. The method of claim 14, wherein the pressure is generated by a lever.

17. The method of claim 14, wherein the pressure is generated by a hydraulic cylinder.

18. The method of claim 14, wherein the pressure is generated by a pneumatic device.

19. The method of claim of claim 14, wherein the pressure is applied to the flange by a rod and a pressure transmitting device.

20. The method of claim 19, wherein the printer cartridge is positioned in between the rod and the pressure transmitting device.

* * * * *